US010457059B2

(12) United States Patent
Todd et al.

(10) Patent No.: US 10,457,059 B2
(45) Date of Patent: Oct. 29, 2019

(54) PRINTING SYSTEM ASSEMBLIES AND TECHNIQUES

(71) Applicant: Kateeva, Inc., Newark, CA (US)

(72) Inventors: Christopher E. Todd, Campbell, CA (US); Stephen Mark Smith, Morgan Hill, CA (US); Alexander Sou-Kang Ko, Santa Clara, CA (US); Robert B. Lowrance, San Jose, CA (US); Eliyahu Vronsky, Los Altos, CA (US)

(73) Assignee: Kateeva, Inc., Newark, CA (US)

( * ) Notice: Subject to any disclaimer, the term of this patent is extended or adjusted under 35 U.S.C. 154(b) by 0 days.

(21) Appl. No.: 15/651,255

(22) Filed: Jul. 17, 2017

(65) Prior Publication Data

US 2018/0029376 A1 Feb. 1, 2018

Related U.S. Application Data

(60) Provisional application No. 62/363,830, filed on Jul. 18, 2016.

(51) Int. Cl.
*B41J 2/175* (2006.01)
*B41J 29/02* (2006.01)

(52) U.S. Cl.
CPC ..... *B41J 2/17596* (2013.01); *B41J 2/175* (2013.01); *B41J 2/17526* (2013.01);
(Continued)

(58) Field of Classification Search
CPC ..... B41J 2/17596
See application file for complete search history.

(56) References Cited

U.S. PATENT DOCUMENTS 4,872,027 A 10/1989 Buskirk et al.
5,786,829 A 7/1998 Pasciak et al.
(Continued)

FOREIGN PATENT DOCUMENTS

CN 109476159 A 3/2019
EP 0668167 A3 4/1996
(Continued)

OTHER PUBLICATIONS

Examination Report dated Oct. 16, 2018, to TW Patent Application No. 106144596.
(Continued)

*Primary Examiner* — Julian D Huffman
(74) *Attorney, Agent, or Firm* — Paula J. Tostado

(57) ABSTRACT

For various embodiments of a printhead assembly or ink stick assembly of the present teachings, each an ink stick assembly can be a self-contained assembly, of which a plurality of self-contained ink stick assemblies can be readily interchanged into a printing system during a printing process. Various embodiments of a self-contained ink stick assembly can have a fluidic system that can include a local ink reservoir, which can be in fluid communication with a bulk ink reservoir. Filling of a bulk ink reservoir can be done in a manual or automated mode. According to the present teachings, a bulk ink reservoir can have a volume sufficient to provide a continuous supply of ink to a local ink reservoir over the course of a printing process.

19 Claims, 8 Drawing Sheets

(52) U.S. Cl.
CPC ..... *B41J 2/17546* (2013.01); *B41J 2/17593* (2013.01); *B41J 29/02* (2013.01)

(56) References Cited

U.S. PATENT DOCUMENTS

| | | | |
|---|---|---|---|
| 5,808,643 | A | 9/1998 | Tracy et al. |
| 6,123,410 | A | 9/2000 | Beerling et al. |
| 6,267,568 | B1 | 7/2001 | Pagnon et al. |
| 6,305,786 | B1 | 10/2001 | Plotkin et al. |
| 6,352,324 | B1 | 3/2002 | Pagnon et al. |
| 6,406,120 | B2 | 6/2002 | Pauschinger |
| 6,540,340 | B2 | 4/2003 | Thorpe et al. |
| 6,799,842 | B2 | 10/2004 | Barinaga et al. |
| 7,341,327 | B2 | 3/2008 | Usuda |
| 7,950,785 | B2 | 5/2011 | Usuda et al. |
| 8,596,769 | B2 | 12/2013 | Hibbard et al. |
| 8,714,719 | B2 | 5/2014 | Mauck et al. |
| 8,857,933 | B2 | 10/2014 | Campion et al. |
| 8,899,171 | B2 | 12/2014 | Mauck et al. |
| 8,927,744 | B2 | 1/2015 | Meza et al. |
| 9,205,664 | B2 | 12/2015 | Mauck et al. |
| 9,505,215 | B2 | 11/2016 | Mauck et al. |
| 2002/0067395 | A1 | 6/2002 | Horii et al. |
| 2003/0122898 | A1 | 7/2003 | Beerling et al. |
| 2003/0175414 | A1 | 9/2003 | Hayashi |
| 2003/0176005 | A1 | 9/2003 | Takano et al. |
| 2004/0003738 | A1 | 1/2004 | Imiolek et al. |
| 2005/0024442 | A1 | 2/2005 | Hirota |
| 2006/0007280 | A1 | 1/2006 | Ang |
| 2011/0149000 | A1 | 6/2011 | Albertalli et al. |
| 2013/0004656 | A1 | 1/2013 | Chen et al. |
| 2013/0321535 | A1* | 12/2013 | Mauck ..... B41J 2/17596 347/85 |
| 2017/0136773 | A1 | 5/2017 | Mauck et al. |

FOREIGN PATENT DOCUMENTS

| | | | |
|---|---|---|---|
| EP | 0688167 | B1 | 11/1998 |
| JP | 2000318184 | A | 11/2000 |
| JP | 2002086709 | A | 3/2002 |
| JP | 2003220713 | A | 8/2003 |
| JP | 2003285425 | A | 10/2003 |
| JP | 2005066491 | A | 3/2005 |
| JP | 2006218624 | A | 8/2006 |
| JP | 2008246855 | A | 10/2008 |
| JP | 2010155422 | A | 7/2010 |
| JP | 201131606 | A | 2/2011 |
| JP | 2011031606 | A | 2/2011 |
| TW | 200303829 | B | 2/2005 |
| TW | 200420179 | B | 3/2010 |
| WO | 2016174643 | A1 | 11/2016 |

OTHER PUBLICATIONS

Office action dated Dec. 17, 2018, to JP Patent Application No. 2018-6175.
Final Office Action dated Jun. 8, 2015, to U.S. Appl. No. 14/257,351.
TW Examination Report dated Apr. 13, 2017 for TW Patent Application No. 105115723.
Informal response filed on Oct. 26, 2017, for the International Search Report and Written Opinion dated Sep. 28, 2017 for International Patent Application No. PCT/US17/42408.
International Search Report and Written Opinion dated Jun. 5, 2013, to PCT Application No. PCT/US2013/032451.
International Search Report and Written Opinion dated Sep. 28, 2017 for International Patent Application No. PCT/US17/42408.
JP Final Official Action dated Sep. 27, 2017 for JP patent Application No. 2015-507012.
JP Official Action dated Nov. 16, 2016 for JP Application No. 2015-507012.
Korean Intellectual Property Office, Notice of first Refusal Ruling, dated Mar. 5, 2018, for No. 9-5-2018-015437308, (translation is 6 pages).
Response filed on Jul. 25, 2016, to Non-Final Office Action dated Mar. 31, 2016, for U.S. Appl. No. 14/953,878.
Non-Final Office Action dated Mar. 31, 2016, to U.S. Appl. No. 14/953,878.
Non-Final Office Action dated May 25, 2017, to U.S. Appl. No. 15/341,801.
Notice of Allowance dated Feb. 26, 2014, to U.S. Appl. No. 13/839,993.
Notice of Allowance dated Jan. 26, 2018, to U.S. Appl. No. 15/341,801.
Notice of Allowance dated Oct. 28, 2015, to U.S. Appl. No. 14/257,351.
Notice of Allowance dated Sep. 7, 2016 for U.S. Appl. No. 14/953,878.
Response filed on Apr. 22, 2015 to the Non-Final Office Action dated Dec. 23, 2014 to U.S. Appl. No. 14/254,351.

* cited by examiner

PRINTING SYSTEM ASSEMBLIES AND TECHNIQUES

OVERVIEW

The present teachings disclose embodiments of an ink stick assembly or ink stick assembly and related apparatuses and devices for use in an industrial printing system that can be used for various printing processes. Various embodiments of an ink stick assembly of the present teachings can include an ink stick assembly, a storage station, and a mounting assembly for mounting an ink stick onto a carriage assembly that is part of a motion system. According to the present teachings, devices, apparatuses, systems and methods disclosed herein can be useful, for example, but not limited by, developing various printing processes, as well as providing for efficient production scale printing.

Various embodiments of an ink stick assembly for use in, for example, but not limited by, the manufacture of an OLED panel substrate, include providing end-user flexibility for the efficient sequential printing of a variety of inks of various formulations on a substrate during a printing process. Ink stick assemblies of the present teachings have self-contained inking systems located within the ink stick assembly that are in fluid communication with one or more plurality of printheads. The ink stick assemblies of the present teachings can be readily shuttled in and out of a printing system, and can be maintained in a storage station proximal a printing system.

BRIEF DESCRIPTION OF THE DRAWINGS

A better understanding of the features and advantages of the present disclosure will be obtained by reference to the accompanying drawings, which are intended to illustrate, not limit, the present teachings. In the drawings, which are not necessarily drawn to scale, like numerals may describe similar components in different views. Like numerals having different letter suffixes may represent different instances of similar components.

DETAILED DESCRIPTION OF THE DISCLOSURE

Figure 1:
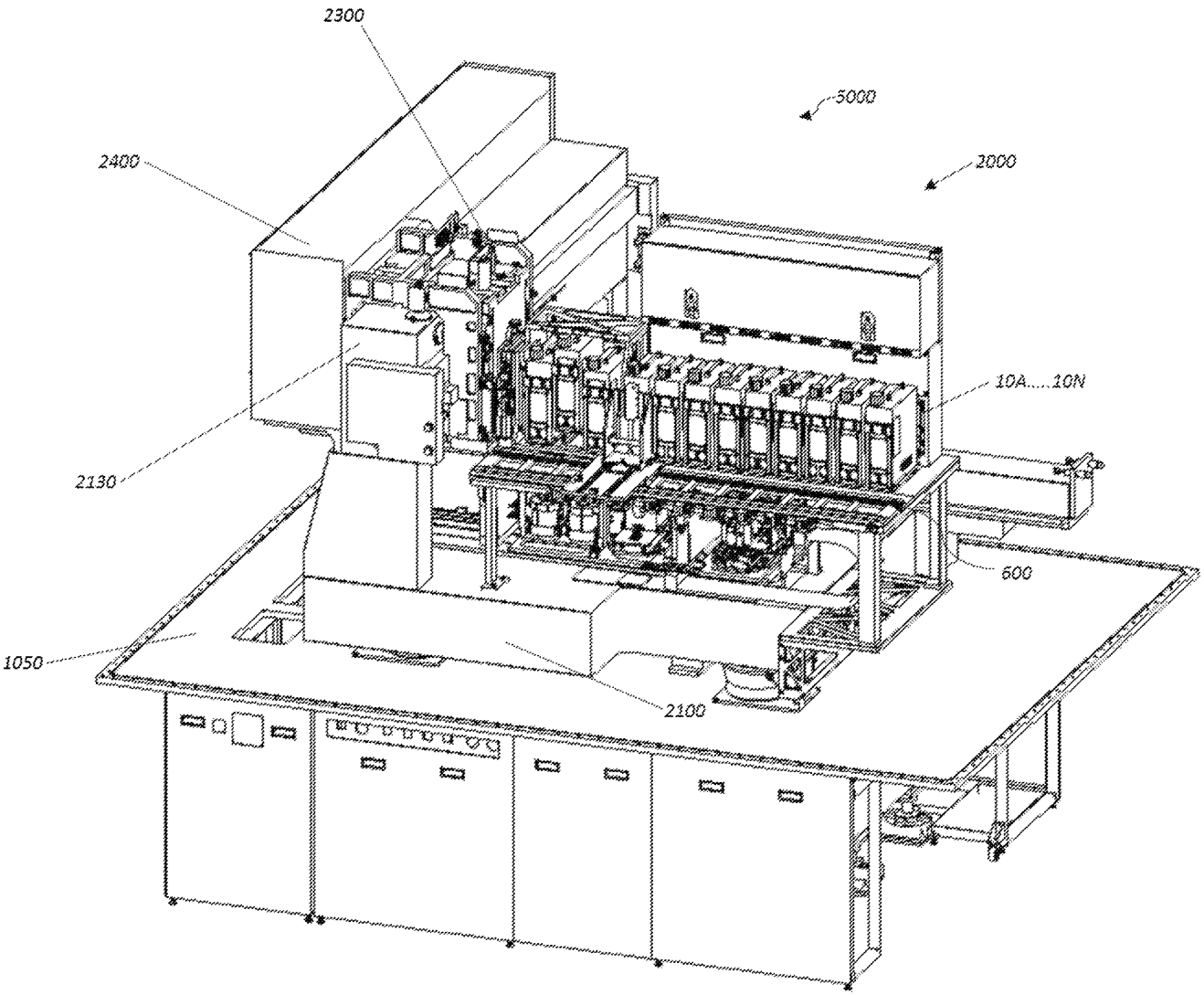
FIG. 1 illustrates generally a perspective view of a printing system of the present teachings.

For various embodiments of a printhead assembly or ink stick assembly of the present teachings, each an ink stick assembly can be a self-contained assembly, of which a plurality of self-contained ink stick assemblies can be readily interchanged into a printing system during a printing process. Various embodiments of a self-contained ink stick assembly can have a fluidic system that can include a local ink reservoir, which can be in fluid communication with a bulk ink reservoir. Filling of a bulk ink reservoir can be done in a manual or automated mode. According to the present teachings, a bulk ink reservoir can have a volume sufficient to provide a continuous supply of ink to a local ink reservoir over the course of a printing process. The replenishment of supply of ink from a bulk ink reservoir to a local ink reservoir can maintain a stable level of ink in a local ink reservoir, which during printing can be fluid communication with a printhead. As such, a stable level of ink in a local ink reservoir can provide for negligible variations in pressure of ink at a plurality of printhead nozzles in a printhead by providing a constant pressure head over a printhead. In that regard, various embodiments of an ink stick assembly can include at least one liquid level indicator for maintaining a defined fill level for the local ink reservoir, so that ink from the bulk ink reservoir continuously replenishes the local ink reservoir to a defined fill level during printing.

Various embodiments of an ink stick assembly can have a manifold assembly that can include an upper manifold assembly, a middle manifold assembly and a lower manifold assembly that have channels with controllable fluid flow fabricated within the manifold assembly. In that regard, a manifold assembly of the present teachings can provide interconnections between the bulk ink reservoir and local ink reservoir in a fluidic subassembly of an ink stick assembly that do not utilize conventional tubing connections. Accordingly, a self-contained ink stick assembly not requiring conventional tubing connections can provide zero dead volume interconnections throughout the fluidic subassembly of an ink stick. Additionally, as the fluidic subassembly is entirely within a self-contained ink stick assembly, the need for cumbersome tubing disconnections and reconnections during exchange of various ink stick assemblies can be eliminated.

In that regard, the efficient interchange of ink stick assemblies is facilitated by a pneumatic interface plate and low-insertion force electrical interface plate that interface with external pneumatic sources and electrical sources required during a printing process. Such external pneumatic sources, such as a nitrogen gas source or a vacuum source, can be readily integrated with the fluidic function of an inks stick. Likewise, external electrical sources can be readily interfaced to the on-board electronic assembly of an ink stick assembly. Various ink stick assemblies of the present teachings have driver boards for each one of more printheads of the ink stick assembly, an I/O and power distribution PCB, as well as a microprocessor board.

In various embodiments of an ink stick assembly, each of a plurality of interchangeable ink stick assemblies can have a unique identification or recognition code. For various embodiments, the identification or recognition code can be indicated physically on an ink stick assembly, as well as electronically associated with each ink stick assembly. For various embodiments of an ink stick assembly, the identification or recognition code can associate each unit with a unique set of operational information for each ink stick assembly. For example, but not limited by, the unique operational information can include a unique location of an ink stick assembly in a maintenance module, the ink formulation contained in the ink stick assembly, and printhead calibration data. Such unique operational information can be stored on a memory device. For various embodiments, the memory device can be an on-board memory device that travels with each ink stick assembly.

Various embodiments of the present teachings include a storage station for storing and maintain a plurality of ink stick assemblies while the ink stick assemblies are not in use. A storage station of the present teachings is located proximal to a motion system of a printing system to provide for efficient exchange of ink sticks during a printing process.

FIG. 1 illustrates generally printing tool 5000, with printing system 2000 that can include printing system base 2100, mounted upon printing tool pan 1050. Printing system 2000, mounted upon printing system base 2100 can include a split axis motion system that includes bridge 2130, upon which X-axis carriage assembly 2300 can be mounted. X-axis carriage can support one of more ink stick assemblies. Movement X-axis carriage 2300 assembly can be controlled with precision using a linear air bearing motion system. Proximal to bridge 2300, storage station 600 can be mounted. Storage station 600 can be used to store and maintain a plurality of ink stick assemblies (10A . . . 10N), as indicated. Various bundles of cabling, wiring, optical fiber and tubing feeding pneumatic providing electrical, fluidic and optical interconnections can be located within e-chain cabinet 2400.

Figure 2:
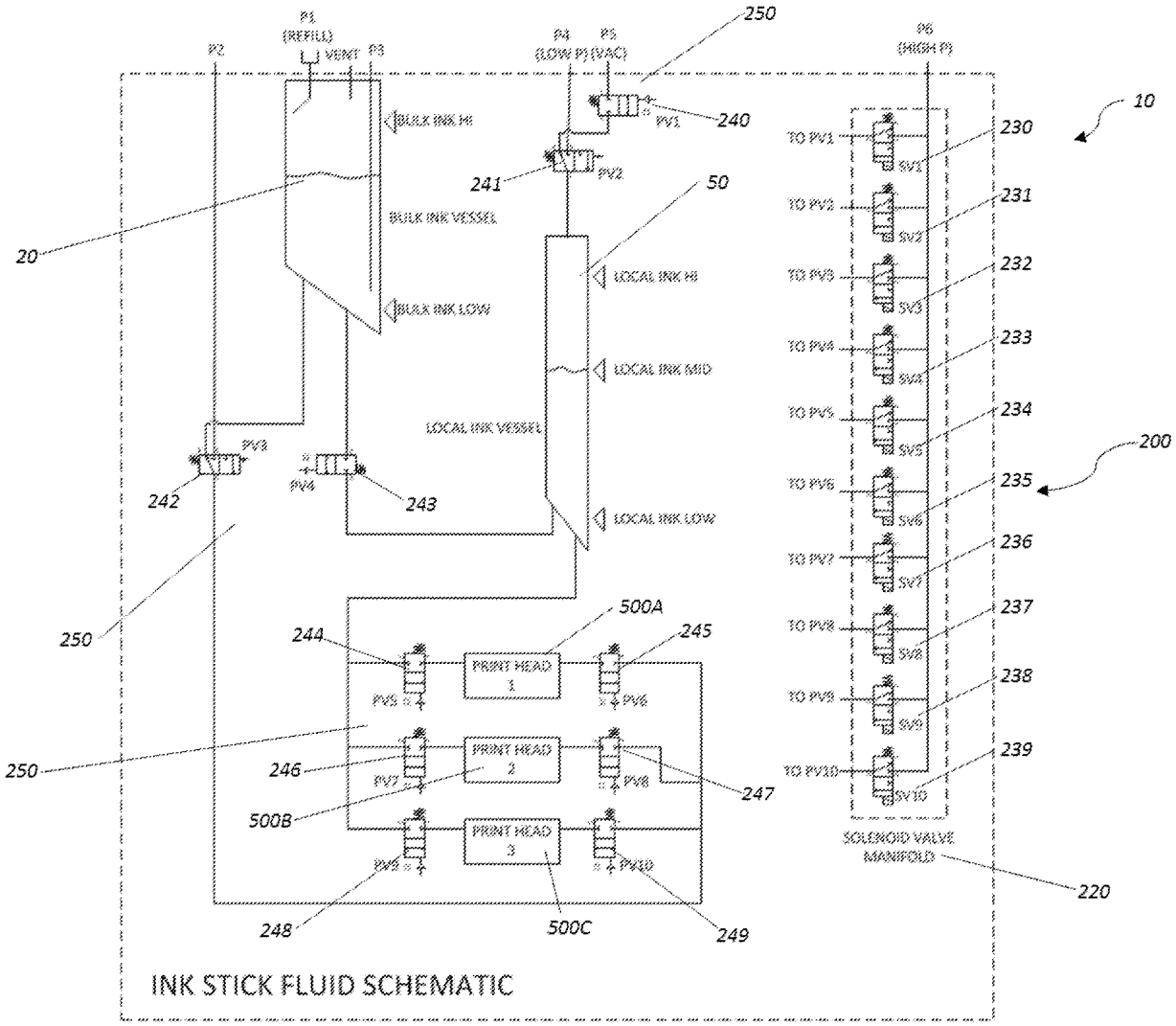
FIG. 2 illustrates generally a schematic diagram of an ink stick assembly including an embodiment of fluidic control.

FIG. 2 illustrates generally a schematic of fluidic elements of ink stick 10 of the present teachings, as well as fluidic interconnections between the fluidic elements and control thereof. An ink stick can have bulk ink reservoir 20, which during a printing operation is in fluid communication with local ink reservoir 50. During a printing operation, local ink reservoir 50 is in fluid communication with one or more printheads; three printheads as depicted in FIG. 2. As shown in FIG. 2, bulk ink reservoir 20 can be in fluid communication with waste line P2. Ink stick 10 can have on-board valve assembly 200 that can include solenoid valve manifold 200, which controls actuation of pneumatic valve assembly 250 that can control fluid distribution of the ink within the ink stick. Pneumatic valve assembly 250 decreases the heat load within the ink stick, which is useful in providing a stable thermal environment for various inks used in a printing process. Solenoid manifold 200 as depicted has a solenoid valve controlling pneumatic input P6 to each pneumatic value of pneumatic valve assembly 250. For example, but not limited by, solenoid valve 230 controls the pneumatic actuation of pneumatic valve 240, which controls a vacuum source to local ink supply 50. Similarly, by way of another non-limiting example, solenoid valve 233 controls the pneumatic actuation of pneumatic valve 243, which controls fluid communication between bulk ink supply 20 and local ink supply 50.

Figure 3A:
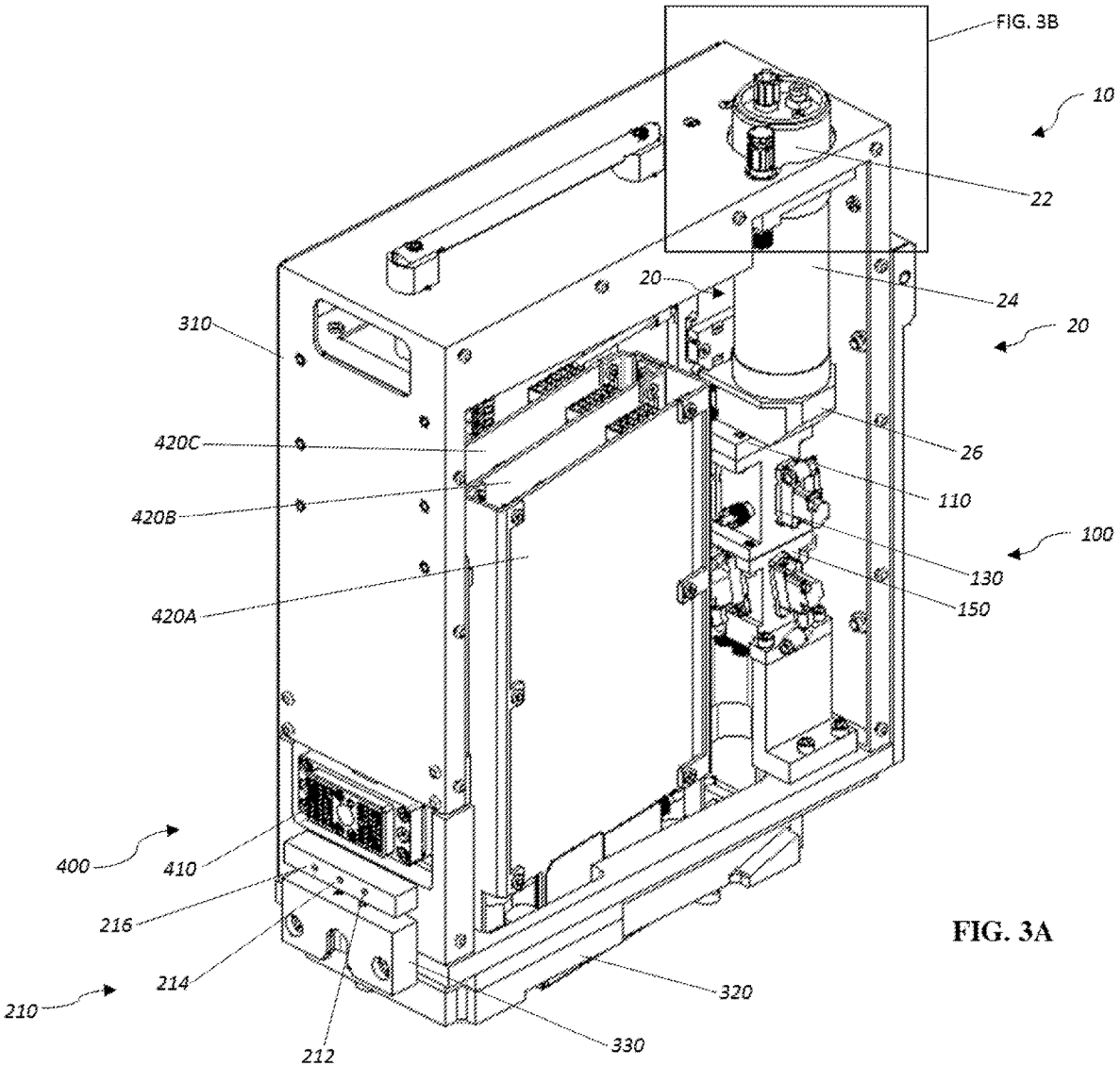
FIG. 3A illustrates generally a schematic perspective view of an ink stick assembly according to the present teachings.
Figure 3B:
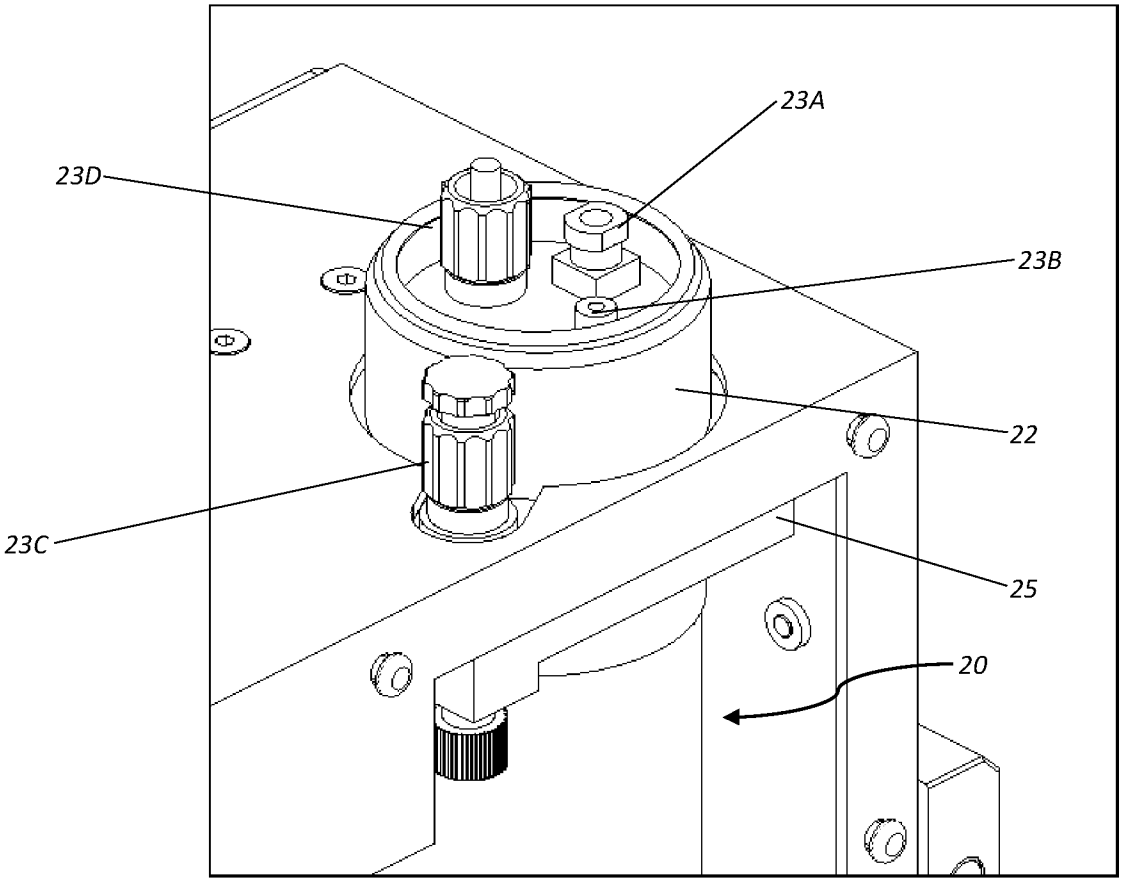
FIG. 3B is an expanded view of the section of an ink stick assembly indicated in FIG. 3A.

In FIG. 3A, a perspective view of ink stick 10 illustrates generally ink stick housing 310, ink stick base 320 and ink stick draw latch 330, which is used in the process of mounting an ink stick into a carriage assembly. Pneumatic interface plate 210 has first port 212 for connection to a high pressure gas source for operating pneumatic valves as previously discussed herein, such as a nitrogen source (see P6 of FIG. 2), second port 214 for connection to vacuum in fluid communication with local ink reservoir 50 (see P5 of FIG. 2), and third port 216 for low pressure gas source, such as a nitrogen source in fluid communication with local ink reservoir 50 (see P4 of FIG. 2). On-board electronic assembly 400 of ink stick 10 can include electronic interface plate 410. Electronic interface plate 410 can provide the required connection to printhead driver board 420A, 420B and 420C, for each printhead 500A, 500B and 500C (see FIG. 2), respectively, as well as other on-board electronic components that will be discussed subsequently herein. Ink stick bulk ink delivery assembly 20 can include top cover 22, reservoir body 24 and bottom cover 26. Top cover 22 and bottom cover 26 include a fluidic interface for bulk ink reservoir 20 to manifold assembly 100. The all-polymeric subassembly can be welded using, for example, IR welding to form a contiguous smooth-walled vessel that eliminates potential for ink retention in dead volume spaces. Manifold assembly 100 of ink stick 10 can include upper manifold 110, middle manifold 130 and lower manifold 150, all of which are in fluid communication and provide fluid connectivity between the bulk ink reservoir and the local ink reservoir via channels fabricated within each manifold. In FIG. 3B, an expanded view of the top portion of bulk ink delivery assembly 20 is shown, which depicts the various ports of bulk ink delivery assembly 20. Port 23A is an ink filling port, shown with a syringe adapter for ease of bubble-free filing using a syringe and port 23B is a vent port, which is required during a filling process. In addition to the filling port and vent port, port 23C is a waste drain port (see P2 of FIG. 2). Finally, port 23D is an ink recovery or extraction port, that allows for recovery of ink from an ink stick. As shown in FIG. 2, port P3, which is port 23C of FIG. 3B, has a tubing that allows the recovery of ink in an ink stick.

Figure 4:
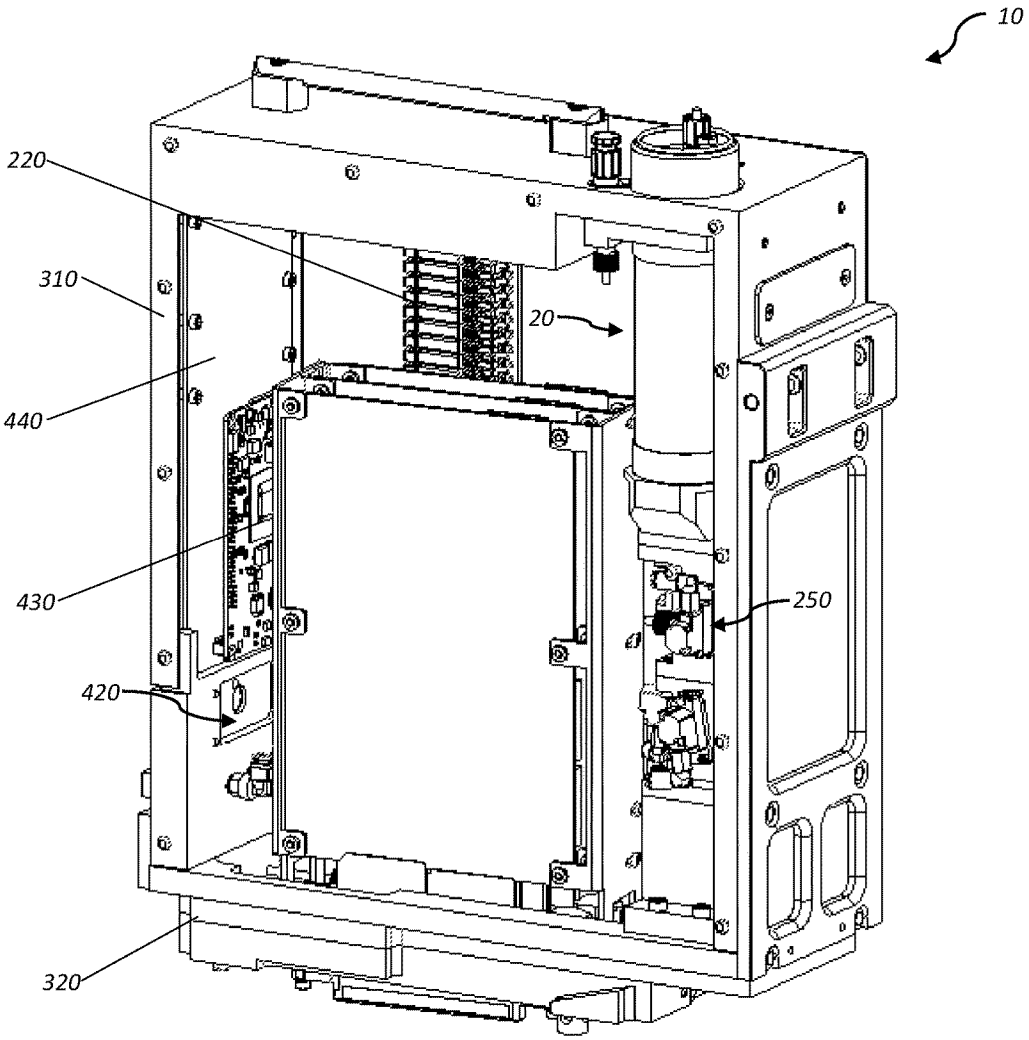
FIG. 4 illustrates generally a schematic front view of an ink stick assembly of the present teachings, including on-board electronic components.

FIG. 4 illustrates generally various assemblies of the on-board electronics included with an ink stick assembly. Within housing 310, the driver board assembly 420, microprocessor 430, and I/O and power distribution printed circuit board (PCB). Additionally, an on-board valve assembly for ink stick 10 can include solenoid valve manifold 220 and pneumatic valves 250 for controlling the fluid flow between fluidic elements of a fluidic subassembly of an ink stick.

Figure 5A:
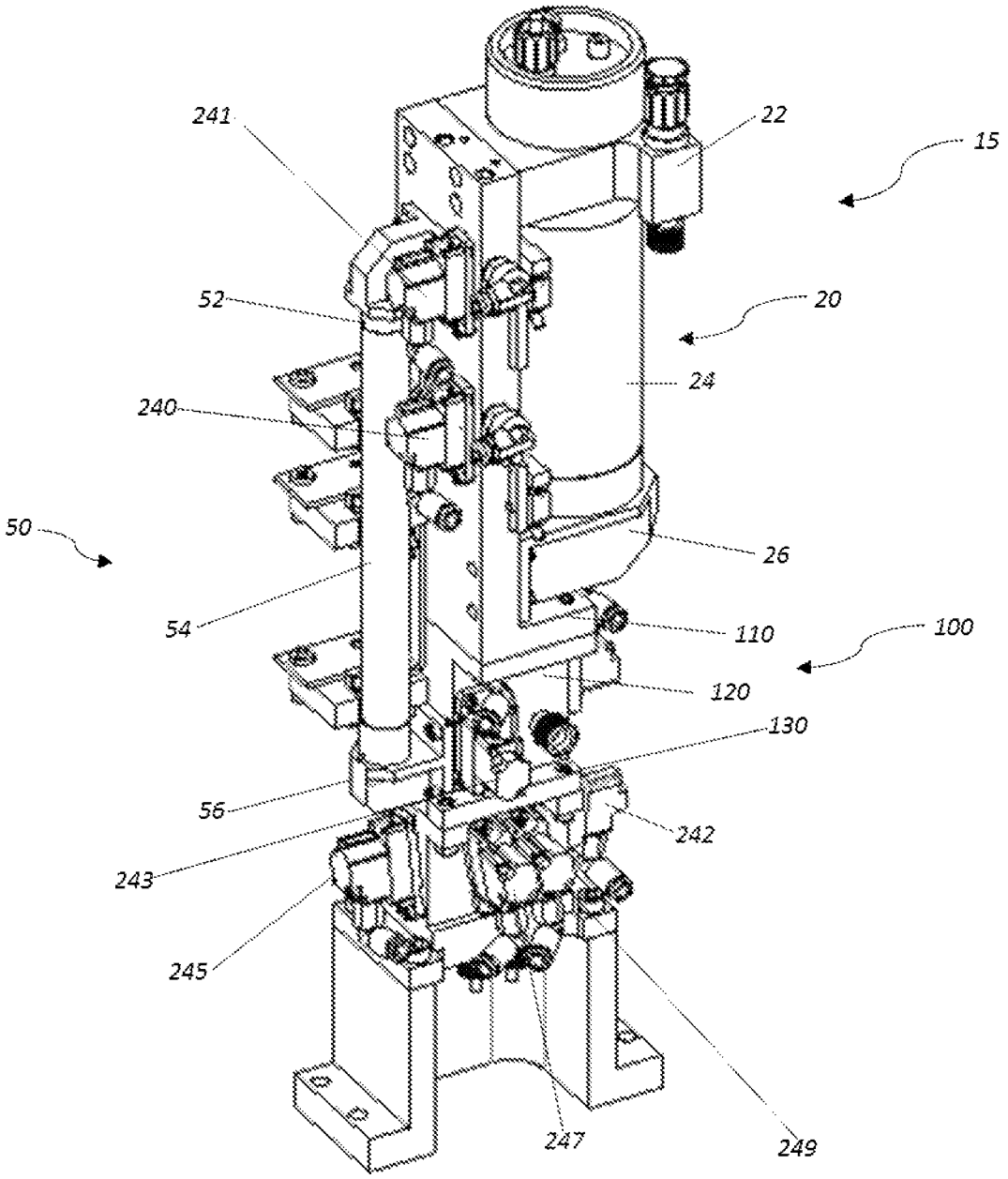
FIG. 5A illustrates generally a schematic perspective side view of a fluidic subassembly of an ink stick assembly of the present teachings.
Figure 5B:
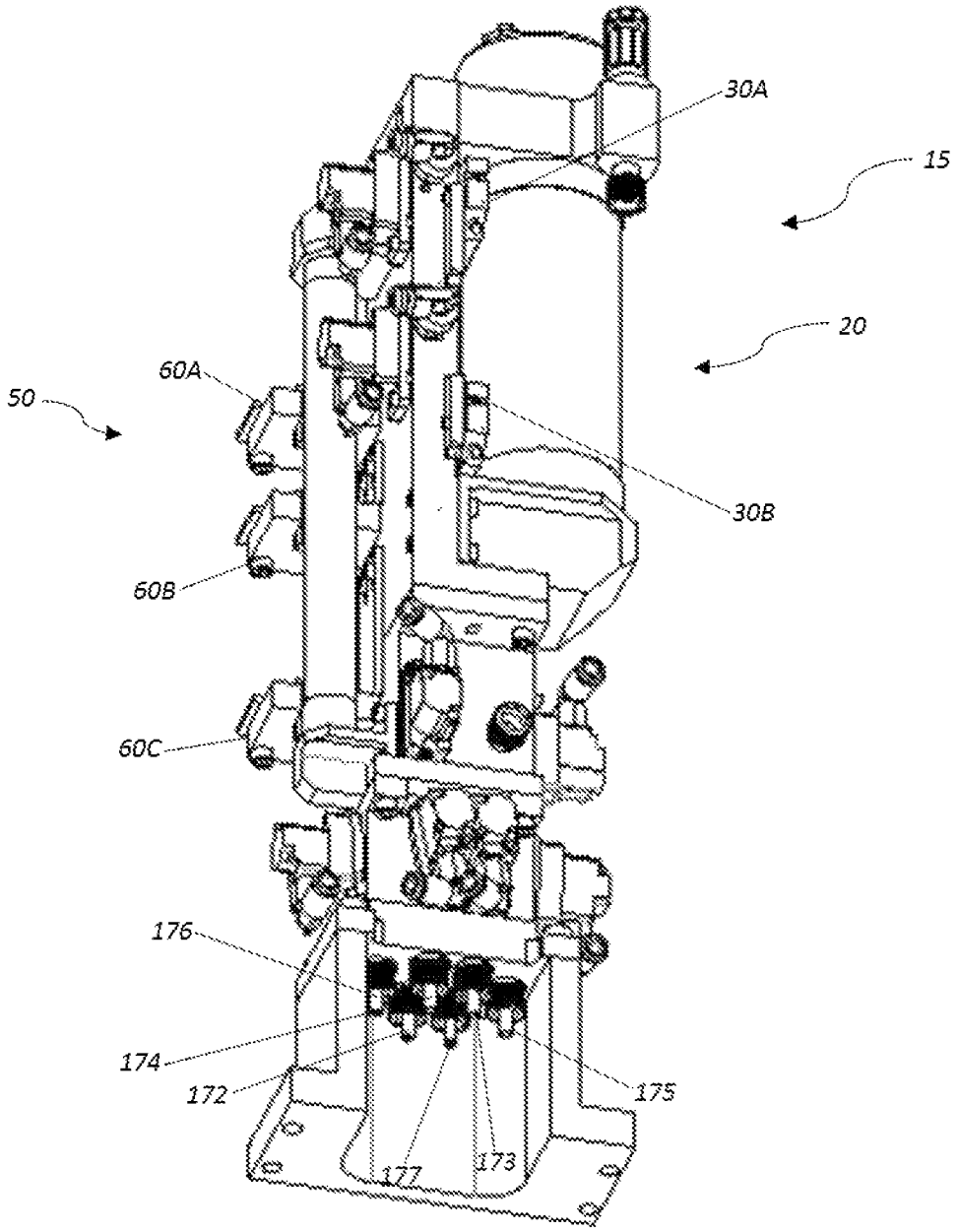
FIG. 5B illustrates generally a schematic bottom perspective view of a fluidic subassembly of an ink stick assembly of the present teachings.

FIG. 5A and FIG. 5B illustrate generally fluidic subassembly 15 of ink stick 10 of FIG. 2 through FIG. 4 of the present teachings. FIG. 5A is a perspective side view of fluidic subassembly 15, depicting bulk ink reservoir assembly 20 and local ink reservoir assembly 50. Ink stick local ink delivery assembly 50 can include top cover 52, reservoir body 54 and bottom cover 56. Top cover 52 and bottom cover 56 include a fluidic interface for local in reservoir 50 to manifold assembly 100. The all-polymeric subassembly can be welded using, for example, IR welding to form a contiguous smooth-walled vessel that eliminates potential for ink retention in dead volume. Manifold assembly 100 of ink stick 10 can include upper manifold 110, middle manifold 130 and lower manifold 150, all of which are in fluid communication and provide fluid connectivity between the bulk ink reservoir and, local ink reservoir via channels fabricated within each manifold. Manifold assembly 100 of ink stick 10 provide zero dead volume connections between the fluidic elements of fluidic subassembly 15. In addition to the zero dead volume connections between the fluidic elements of fluidic subassembly 15, pneumatic valves of pneumatic manifold assembly 250 decrease the heat load proximal to fluidic subassembly 15, providing a stable thermal environment within an ink stick thereby. By way of non-limiting examples: pneumatic valve 240 of fluidic subassembly 15 controls the connection to a vacuum source (see P5 of FIG. 2), pneumatic valve 241 of fluidic subassembly 15 controls the connection to a low-pressure gas source (see P4 of FIG. 2), 3) pneumatic valve 242 of fluidic subassembly 15 controls the connection between printheads as well as the bulk ink reservoir to a waste line (see P2 of FIG. 2), and pneumatic valve 243 of fluidic subassembly 15 controls the connection between the bulk ink reservoir and the local ink reservoir.

FIG. 5B is a bottom perspective view of fluidic subassembly 15 illustrating generally various fluid level sensor assemblies associated with the bulk ink reservoir and local ink reservoir. Bulk ink reservoir 20 can have an upper level fluid sensor 30A and lower level fluid sensor 30B. Local ink reservoir 50 can have an upper level fluid sensor 60A, a mid-level fluid sensor 60B and lower level fluid sensor 30B. According to the present teachings, the fluidic system of an ink stick is configured so bulk ink reservoir 20 can maintain the fluid level within local ink reservoir to a stable level. As such, a stable level of ink in a local ink reservoir can provide for negligible variations in pressure of ink at a plurality of printhead nozzles in a printhead by providing a constant pressure head over a printhead. Fluidic subassembly 15 can provide inlet fittings and outlet fittings for interconnections with at least one printhead. For example, inlet fitting 172 and outlet fitting 173 can be used to connect a first printhead, while inlet fitting 174 and outlet fitting 175 can be used to connect a second printhead, and inlet fitting 176 and outlet fitting 177 can be used to connect a third printhead.

Figure 6:
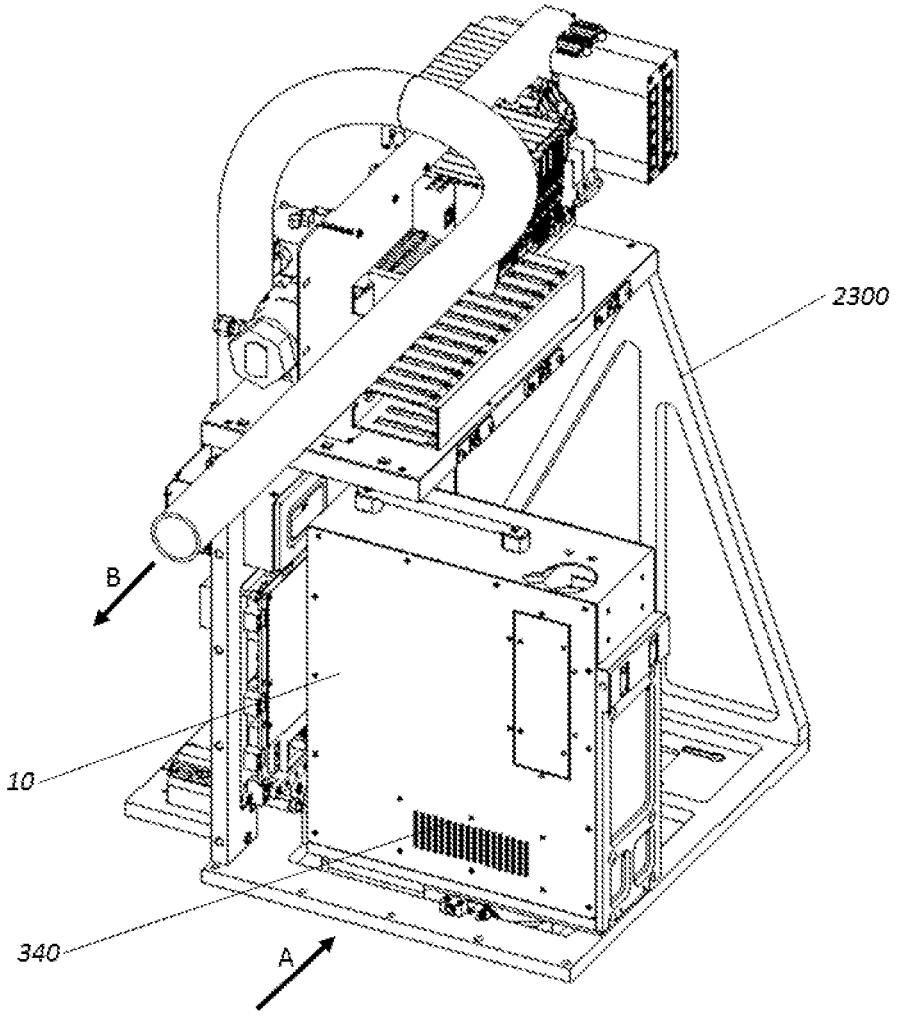
FIG. 6 illustrates generally a schematic perspective view of an ink stick assembly of the present teachings in position for mounting onto a carriage assembly of a printing system.

FIG. 6 illustrates generally carriage assembly 2300, which can be mounted to a motion system of a printing system (see FIG. 1). As previously discussed herein, maintaining a stable thermal environment in a fluidic system can be desirable, by way of a non-limiting example, for a variety of inks that require a constant thermal environment for chemical stability or for properties, such as stable jetting. Given that various on board electronic components of an ink stick can generate heat during operation, during a printing process, air can be drawn through vent 340 of an ink stick, as depicted by arrow A and then exhausted through an exhaust pipe or duct as shown by arrow B, thereby dissipating heat generated by electronic components of an ink stick and maintaining a stable internal thermal environment within an ink stick.

What is claimed is:

1. An ink stick assembly for use with a printing tool, the ink stick assembly comprising:

printheads;

for each printhead, a driver board;

an electrical interface to detachably provide electrical connection between each of the driver boards and the printing tool;

a pneumatic interface to detachably provide pneumatic connection between the ink stick assembly and the printing tool;

an ink reservoir to supply ink to the printheads;

a pneumatic manifold in fluid communication with the pneumatic interface;

pneumatically-actuated valves, each pneumatically-actuated valve to control a flow of ink in the ink stick assembly; and for each given one of the pneumatically-actuated valves, a solenoid to control fluidic exchange between the given one of the pneumatically-actuated valves and the pneumatic manifold.

2. The ink stick assembly of claim 1, wherein each solenoid is thermally-separated from ink supplied from the ink reservoir to the printheads.

3. The ink stick assembly of claim 1, wherein there are at least three of the printheads and at least three of the pneumatically-actuated valves, including a pneumatically-actuated valve respective to each of the printheads, to control flow of ink from the ink reservoir to the respective printhead.

4. The ink stick assembly of claim 1, wherein:

the ink reservoir is a first ink reservoir, and the ink stick assembly further comprises a second ink reservoir; and one of the pneumatically-actuated valves is to control flow of ink between the first ink reservoir and the second ink reservoir.

5. The ink stick assembly of claim 4, wherein:

the ink stick assembly further comprises an ink-filling port to selectively receive ink to replenish the second ink reservoir; and the ink stick assembly further comprises fill regulation means for selectively controlling the one of the pneumatically-actuated vales to resupply the first ink reservoir with ink from the second ink reservoir.

6. The ink stick assembly of claim 5, wherein the ink-filling port comprises a syringe adapter to receiving ink from a syringe.

7. The ink stick assembly of claim 1, further comprising at least one pneumatically-actuated valve to control a flow of ink in the ink stick assembly, said at least one pneumatically-actuated valve operatively coupled to the pneumatic interface, said at least one pneumatically-actuated valve to be selectively opened and closed in response to pneumatic impetus provided by the pneumatic connection.

8. The ink stick assembly of claim 1, wherein the electrical interface is to supply a low connection-force mating engagement with a reciprocal interface of the printing tool.

9. The ink stick assembly of claim 1, wherein the pneumatic interface is to supply a low connection-force mating engagement with a reciprocal interface of the printing tool.

10. The ink stick assembly of claim 1, further comprising on-board digital memory to store calibration data respective to each of the printheads and an identification code to distinguish said ink stick assembly from other ink stick assemblies.

11. The ink stick assembly of claim 1, further comprising on-board digital memory to store data describing ink formulation carried by said ink stick assembly.

12. An apparatus comprising:

a printing tool; and a plurality of ink stick assemblies for interchangeable use with a printing tool, each of the ink stick assemblies comprising printheads, for each printhead, a driver board, an electrical interface to detachably provide electrical connection between each of the driver boards and the printing tool, a pneumatic interface to detachably provide pneumatic connection between the ink stick assembly and the printing tool, a pneumatic manifold in fluid communication with the pneumatic interface;

pneumatically-actuated valves, each pneumatically-actuated valve to control a flow of ink in the ink stick assembly;

for each given one of the pneumatically-actuated valves, a solenoid to control fluidic exchange between the given one of the pneumatically-actuated valves and the pneumatic manifold; and an ink reservoir to supply ink to the printheads.

13. The apparatus of claim 12, wherein for each of the ink stick assemblies, each solenoid is thermally-separated from ink supplied from the ink reservoir to the printheads.

14. The apparatus of claim 12, wherein for each of the ink stick assemblies, there are at least three of the printheads and at least three of the pneumatically-actuated valves, including a pneumatically-actuated valve respective to each of the printheads, to control flow of ink from the ink reservoir to the respective printhead.

15. The apparatus of claim 12, wherein for each of the ink stick assemblies:

the ink reservoir is a first ink reservoir, and the ink stick assembly further comprises a second ink reservoir; and one of the pneumatically-actuated valves is to control flow of ink between the first ink reservoir and the second ink reservoir.

16. The apparatus of claim 15, wherein each of the ink stick assemblies further comprises:

an ink-filling port to selectively receive ink to replenish the second ink reservoir; and fill regulation means for selectively controlling the one of the pneumatically-actuated vales to resupply the first ink reservoir with ink from the second ink reservoir.

17. The apparatus of claim 12, wherein each given one of the ink stick assemblies further comprises at least one pneumatically-actuated valve to control a flow of ink in the given one of the ink stick assemblies, said at least one pneumatically-actuated valve operatively coupled to the pneumatic interface, said at least one pneumatically-actuated valve to be selectively opened and closed in response to pneumatic impetus provided by the pneumatic connection.

18. The apparatus of claim 12, wherein each given one of the ink stick assemblies further comprises on-board digital memory to store calibration data respective to each of the printheads and an identification code to distinguish said ink stick assembly from other ink stick assemblies.

19. The apparatus of claim 12, wherein each given one of the ink stick assemblies further comprises on-board digital memory to store data describing ink formulation carried by said given one of the ink stick assemblies.

* * * * *